US008233831B2

(12) United States Patent
Nakayama et al.

(10) Patent No.: US 8,233,831 B2
(45) Date of Patent: Jul. 31, 2012

(54) FIXING DEVICE WITH CLEANING SECTION FOR IMAGE FORMING APPARATUS

(75) Inventors: Atsuyoshi Nakayama, Osaka (JP); Toshiaki Kagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 424 days.

(21) Appl. No.: 12/481,777

(22) Filed: Jun. 10, 2009

(65) Prior Publication Data

US 2009/0311015 A1 Dec. 17, 2009

(30) Foreign Application Priority Data

Jun. 11, 2008 (JP) ..... P2008-153516

(51) Int. Cl.
*G03G 15/20* (2006.01)

(52) U.S. Cl. ..... 399/327; 399/329

(58) Field of Classification Search ..... 399/327, 399/329–331; 219/216

See application file for complete search history.

(56) References Cited

U.S. PATENT DOCUMENTS

| | | | | |
|---|---|---|---|---|
| 6,799,000 | B2 * | 9/2004 | Aslam et al. | 399/45 |
| 7,010,255 | B2 * | 3/2006 | Yura et al. | 399/328 |
| 2002/0181981 | A1 | 12/2002 | Muto et al. | |
| 2004/0109712 | A1 | 6/2004 | Muto et al. | |
| 2005/0214043 | A1 * | 9/2005 | Kameda | 399/328 |
| 2007/0217838 | A1 * | 9/2007 | Yamana et al. | 399/328 |
| 2007/0248389 | A1 * | 10/2007 | Asakura et al. | 399/328 |
| 2007/0264059 | A1 * | 11/2007 | Maeda et al. | 399/320 |
| 2008/0124144 | A1 * | 5/2008 | Mukai et al. | 399/327 |
| 2009/0003898 | A1 * | 1/2009 | Kayahara et al. | 399/327 |
| 2010/0061778 | A1 * | 3/2010 | Kagawa | 399/327 |
| 2010/0183346 | A1 * | 7/2010 | Kagawa et al. | 399/327 |

FOREIGN PATENT DOCUMENTS

| | | | |
|---|---|---|---|
| CN | 1375749 | A | 10/2002 |
| JP | 9-269693 | A | 10/1997 |
| JP | 2005-172966 | A | 6/2005 |
| JP | 2005-234290 | A | 9/2005 |
| JP | 2007-304440 | A | 11/2007 |
| JP | 2008-90172 | A | 4/2008 |

* cited by examiner

*Primary Examiner* — David Gray
*Assistant Examiner* — G. M. Hyder
(74) *Attorney, Agent, or Firm* — Birch, Stewart, Kolasch & Birch, LLP

(57) ABSTRACT

In a fixing device including a fixing roller, a pressure roller and an external heating section, a scraper is arranged to contact a circumferential surface of an external heating belt and scrape toner and the like on the circumferential surface to thereby clean the circumferential surface. In addition, a material that has higher adherence to toner than on a circumferential surface of the fixing roller is used for the external hating belt to thereby peel the toner and the like on the circumferential surface of the fixing roller and clean the circumferential surface of the fixing roller. Further, as a vibration applying section adapted to apply vibration to the scraper, a first contact/separation section adapted to contact/separate the external heating section with/from the fixing roller is provided. Vibration is applied to the scraper by the first contact/separation to peel the toner and the like off the scraper.

14 Claims, 8 Drawing Sheets

FIXING DEVICE WITH CLEANING SECTION FOR IMAGE FORMING APPARATUS

CROSS-REFERENCE TO RELATED APPLICATION

This application claims priority to Japanese Patent Application No. 2008-153516, which was filed on Jun. 11, 2008, the contents of which are incorporated herein by reference in their entirety.

BACKGROUND OF THE INVENTION

1. Field of the Invention

The present invention relates to a fixing device and an image forming apparatus.

2. Description of the Related Art

An electrophotographic image forming apparatus is capable of forming a high-quality image with favorable reproducibility and operability at low costs. This is why the electrophotographic image forming apparatus has been widely used in a copier, a printer, a facsimile machine, a multifunction machine having two or more of these functions just stated, and the like machine. The electrophotographic image forming apparatus includes, for example, a photoreceptor, a charging section, an exposing section, a developing section, a transfer section, and a fixing section. The photoreceptor is a member on whose surface an electrostatic latent image corresponding to image information is formed. The charging section serves to charge a surface of the photoreceptor. The exposing section serves to irradiate the charged surface of the photoreceptor with signal light to thereby form an electrostatic latent image. The developing section serves to supply toner to the electrostatic latent image formed on the surface of the photoreceptor, to thereby form a toner image. The transfer section serves to transfer the toner image formed on the surface of the photoreceptor to a recording medium. The fixing section serves to fix the toner image on the recording medium to thereby form an image.

As such a fixing device, there has been generally known a fixing device in a thermal fixing system in which a toner image on recording paper is fused with heat and fixed on the recording paper by a roller pair system constituted by a fixing roller and a pressure roller, as shown in Japanese Unexamined Patent Publication JP-A 2007-304440.

The fixing roller is a roller member having an elastic layer formed on the surface of a metal-made hollow metal core, such as aluminum, and a halogen lamp is provided inside the metal core as a heat source. The temperature of the fixing roller is controlled by controlling on/off of the halogen lamp based on a signal output from a temperature sensor provided on the surface of the fixing roller by a temperature control device.

The pressure roller is a roller member having a heat-resistant elastic layer such as silicone rubber formed on a metal core as a coating layer. The pressure roller is brought into pressure-contact with the surface of the fixing roller, and due to elastic deformation of the elastic layer of the pressure roller, a pressure-contact region called a nip portion is formed between the fixing roller and the pressure roller.

In the configuration above, the fixing device sandwiches recording paper having an unfixed toner image formed thereon at the nip portion, rotates the fixing and pressure rollers to transport the recoding paper, and fuses a toner image on a recording material with heat on the surface of the fixing roller to fix to the recording paper.

In such a fixing device, offset phenomena such as cold offset and hot offset are known to occur when the surface temperature of the fixing roller falls outside of a suitable temperature range. The cold offset is a phenomenon in which a part of toner that did not melt sufficiently due to shortage of heat transferred to the recording paper adheres to the fixing roller. On the other hand, the hot offset is a phenomenon in which a part of toner on the recording paper adheres to the fixing roller due to a weakened toner cohesive force caused by overheating of the toner on the recording paper.

In order to prevent image contamination on recording paper due to offset phenomena, a cleaning section composed of a cleaning web and the like that is brought into contact with a fixing roller is generally provided as shown in the JP-A 2007-304440. Although most of the toner adhering to the fixing roller is removed by the cleaning section, not all of the toner is removed.

Accordingly, in order to prevent offset phenomena, it is very important in the fixing device to control the temperature so that the surface temperature of the fixing roller falls within a suitable temperature range while the recording paper passes.

A suitable temperature range for the surface of the fixing roller varies depending on recording paper transport speed of an image forming apparatus provided with the fixing device. Specifically, the suitable temperature range tends to shift to the high-temperature side with increase in the recording paper transport speed and to the low-temperature side with decrease in the recording paper transport speed. This is because the contact time of the recording paper and the surface of the fixing roller is short when the recording paper transport speed is fast, and the surface temperature of the fixing roller is required to be relatively high to transfer sufficient heat from the surface of the fixing roller to the recording paper. In addition, the contact time of the recording paper and the surface of the fixing roller is long when the recording paper transport speed is slow, where excessive heat is transferred from the surface of the fixing roller to the recording paper unless the surface temperature of the fixing roller is restrained.

A so-called four-cycle image forming apparatus is generally designed so that the recording sheet transport speed is almost the same for the case of forming color images and the case of forming monochromatic images on recording paper. However, the distance between transported recording sheets of recording paper is different between the case of color images and the case of monochromatic images, and the number of processed sheets per unit of time is greater in the case of monochromatic images. Note that, a four-cycle image forming apparatus forms toner images of four colors cyan (C), magenta (M), yellow (Y), and black (B) by a pair of visualized image forming units, which are overlaid to form a color image.

Accordingly, in a fixing device provided in the four-cycle image forming apparatus, there are two non-offset ranges of a suitable temperature range (non-offset range) for fixing color images and a suitable temperature range (non-offset range) for fixing monochromatic images, and the common non-offset range is sufficiently wide. It is therefore easy to set a control value (target value) for the surface temperature of the fixing roller within the common non-offset range and to control the surface temperature of the fixing roller within the suitable temperature range in both the case of fixing color images and the case of fixing monochromatic images. As a result, the four-cycle image forming apparatus is capable of avoiding the offset phenomena easily.

Meanwhile, in a recent image forming apparatus employing a four-drum tandem engine, that is, in an image forming apparatus in which four sets of visualized image forming units respectively corresponding to four colors of C, M, Y, and B are arranged in series, there is an increasing demand for designing so as to provide faster recording paper transport speed in the case of forming monochromatic images than the case of forming color images. According to this demand, the recording paper transport speed is largely different between a monochromatic mode forming monochromatic images and a color mode forming color images. Even with such design, it is possible to increase the number of processed sheets for monochromatic images per unit time without deteriorating image quality in formed monochromatic images.

As described above, in the image forming apparatus that is designed to increase the number of processed sheets for monochromatic images, the common non-offset range in the non-offset range for fixing color images and the non-offset range for monochromatic images is significantly narrow. When the common non-offset range is significantly narrow in this manner, it is difficult to control the surface temperature of the fixing roller within the common non-offset range even when a control value (target value) for the surface temperature of the fixing roller is set within the common non-offset range, resulting that offset phenomena are easily caused.

Further, for the paper passing operation from a standby state, the temperature needs to be set to enable paper passing both in the monochromatic mode and the color mode. Thus, during the standby state, the surface temperature of the fixing roller needs to be controlled between a lower limit of fixing temperature for the monochromatic mode and an upper limit of fixing temperature for the color mode, and be quickly switched between the monochromatic mode and the color mode in the subsequent paper passing operation.

For accurately controlling the surface temperature of the fixing roller in a fixing device for color, an external heating section such as an external heating roller or an external heating belt that is in contact with the surface of the fixing roller is more suitable than an internal heating section such as a halogen lamp provided inside the fixing roller. Accordingly, it is important to control the temperature by the external heating section for controlling the surface temperature of the fixing roller to fall within a narrow temperature range.

For example, in one method for temperature control by the external heating section, contact/separation of the external heating section is controlled based on information of the surface temperature of the fixing roller so as to instantly raise or lower the surface temperature of the fixing roller. It is possible to control the surface of the fixing roller at a predetermined temperature by bringing the external heating section into contact with the fixing roller to increase the surface temperature of the fixing roller or separating the external heating section from the fixing roller to prevent overheating of the fixing roller according to a print mode.

However, there is also a problem in the contact/separation operation for the external heating section. The fixing roller having the external heating section is generally provided with the cleaning section as described above on the upstream side of the external heating section in a rotational direction of the fixing roller. Even when offset phenomena are caused, the cleaning section reduces much of the toner contamination on the fixing roller. However, since the cleaning capability of the cleaning section is not perfect, the toner contamination accumulates on the external heating section that is in contact with the fixing roller. As the toner accumulates on the external heating member to a certain extent, the toner adhering to the external heating section is sometimes peeled from the external heating section collectively and transferred to the fixing roller by the vibration caused when the external heating section is brought into contact with the fixing roller. When a certain quantity of toner is transferred from the external heating section to the surface of the fixing roller, the toner adheres to the recording paper during paper passing by the fixing roller, thus causing a problem that the print face is contaminated.

In order to solve the problem, as shown in the JP-A 2007-304440, a fixing device has been proposed that is provided with a control section that controls the contact/separation section so as to bring the external heating section into contact with the fixing roller at such a timing that an initial contact portion, which is a portion of the external heating section on the fixing roller where the external heating section is initially brought into contact with the fixing roller, does not make contact with the recording paper in one rotation of the fixing member.

However, in the invention of the JP-A 2007-304440, since the external heating section is not provided with a cleaning section, the control of the contact/separation operation of the external heating section for the fixing section is more complicated in order to further prevent adhesion of toner and the like to the external heating section. Further, even when the adhesion of the toner and the like to the external heating section can be prevented completely, a cleaning web for cleaning the fixing roller is essential and the apparatus becomes large by arranging the cleaning web.

SUMMARY OF THE INVENTION

An object of the invention is to provide a fixing device provided with a fixing section, a pressure section, and an external heating section capable of cleaning the fixing section and the external heating section even with a small and simple configuration without complicating control to adjust a contact/separation operation with respect to the fixing section so as to maintain cleanness of the external heating section and without causing enlargement due to arrangement of a cleaning web, and an image forming apparatus including the fixing device.

The invention provides a fixing device, comprising:

a fixing section adapted to be rotatable around an axial line thereof, and heat a recording material bearing an unfixed toner image to fuse toner constituting the unfixed toner image on the recording material;

a pressure section adapted to be rotatable and form a pressure-contact section between the pressure section and the fixing section by pressure-contact to the fixing section and apply pressure to the recording material bearing the unfixed toner image transported to the pressure-contact section to fix the toner on the recording material in cooperation with the fixing section; and an external heating section having a plurality of supporting rollers and a belt supported around the plurality of supporting rollers with tension so as to be rotatable, the belt being disposed so as to contact a circumferential surface of the fixing section from an outside to heat the circumferential surface; and a cleaning section adapted to contact the belt, and scrape contamination on a surface of the belt to thereby clean the surface; and a vibration applying section adapted to apply vibration to the cleaning section.

According to the invention, there is provided a fixing device including a fixing section, a pressure section, an external heating section, and a cleaning section. In the fixing device of the invention, the external heating section includes a plurality of supporting rollers and a belt supported around a plurality of supporting rollers with tension to be rotatable, the belt being disposed so as to contact a circumferential surface of the fixing section from an outside to heat the circumferential surface. Moreover, the cleaning section is provided to contact a surface of the belt, and when the belt is rotated, offset toner and paper dust that is contamination of the surface of the belt (hereinafter referred to as toner and the like) are scraped by the cleaning section and removed from the external heating section. Accordingly, in the invention, it is possible to maintain cleanness of the external heating section without complicating control to adjust a contact/separation operation with respect to the fixing section so that the toner and the like do not adhere to the external heating section.

Further, the fixing device according to the invention comprises a vibration applying section adapted to apply vibration to the cleaning section. By applying vibration to the cleaning section, it is possible to peel the toner and the like adhering to the cleaning section and remove them from the cleaning section. Accordingly, in the invention, it is possible to prevent the toner and the like from adhering to the belt again from the cleaning section.

Further, in the invention, it is preferable that the belt is made of a material having higher adherence to toner than on the circumferential surface of the fixing section.

According to the invention, a material having higher adherence to toner than on the circumferential surface of the fixing section is used for the belt. Since the belt is provided to be brought into contact with the circumferential surface of the fixing section, the toner and the like shift from the circumferential surface to the belt that has high adherence to toner. Accordingly, in the invention, it is possible to maintain cleanness of the fixing section without arranging a cleaning web and is capable of significantly miniaturizing the fixing device.

Further, in the invention, it is preferable that the fixing device further comprises a first contact/separation section adapted to contact/separate the external heating section with/from the fixing section, and the first contact/separation section serves as the vibration applying section.

According to the invention, the fixing device further comprises a first contact/separation section adapted to contact/separate the external heating section with/from the fixing section, and the first contact/separation section serves as the vibration applying section. By adjusting speed of the external heating section in contact, it is possible to apply enough vibration to peel the toner and the like from the cleaning section. Accordingly, in the invention, it is possible to apply vibration to the cleaning section, and it is not necessary to provide an additional vibration applying section.

Further, in the invention, it is preferable that the fixing device further comprises a second contact/separation section adapted to contact/separate the pressure section with/from the fixing section, and the second contact/separation section serves as the vibration applying section.

According to the invention, the fixing device further comprises a second contact/separation section adapted to contact/separate the pressure section with/from the fixing section, and the second contact/separation section serves as the vibration applying section. When contact/separation of the pressure section is performed, vibration is applied to the fixing section and the vibration is transferred from the fixing section to the external heating section so that the vibration is applied to the cleaning section. By adjusting speed of the pressure section in contact, it is possible to apply enough vibration to peel the toner and the like from the cleaning section. Accordingly, in the invention, it is possible to apply vibration to the cleaning section, and it is not necessary to provide an additional vibration applying section.

Further, in the invention, it is preferable that the fixing device further comprises a detecting section adapted to detect temperature of the belt, and when the detected temperature is lower than a softening temperature of toner, the vibration applying section applies vibration to the cleaning section.

According to the invention, the fixing device further comprises a detecting section adapted to detect temperature of the belt, and when the detected temperature is lower than a softening temperature of toner, the vibration applying section applies vibration to the cleaning section. When the temperature of toner becomes lower than the softening temperature of toner, the viscosity thereof is suddenly lost. Thus, only in a case where the temperature of the belt is lower than the softening temperature of toner, it is possible to cause the toner and the like to be peeled from the cleaning section sufficiently even when vibration is applied to the cleaning section. Accordingly, in the invention, it is possible to reduce a vibration force of the vibration that is necessary for removing the toner and the like from the cleaning section and the number of vibration, and long-term stable use is possible.

Further, in the invention, it is preferable that the cleaning section includes a-toner collecting section adapted to collect the contamination scraped from the surface of the belt.

According to the invention, the cleaning section includes a toner collecting section adapted to collect the contamination scraped from the surface of the belt. The toner and the like peeled from the cleaning section, which are the contamination scraped from the surface of the belt, are collected in the toner collecting section. Accordingly, in the invention, it is possible to prevent the toner and the like peeled from the cleaning section from adhering to the fixing device and the recording material.

Further, in the invention, it is preferable that the toner collecting section has a bottom face inclined in a longitudinal direction of the fixing section.

According to the invention, used is the toner collecting section that has a bottom face inclined in a longitudinal direction of the fixing section. The bottom face of the toner collecting section is inclined so that the peeled toner and the like are reserved further downward in the toner collecting section. Accordingly, in the invention, it is possible to allow a work of cleaning the toner collecting section to be performed easily.

Further, the invention provides an image forming apparatus provided with the fixing device mentioned above.

According to the invention, an image forming apparatus provided with the fixing device of the invention is provided. According to the image forming apparatus, even when speeding-up of image forming speed is performed, fixing failure of an image, generation of image contamination due to adhesion of the toner and the like to the recording material, and the like are prevented so that high-quality images can be formed over a long period stably. In addition, these effects are attained without complicating control and enlargement of the apparatus.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
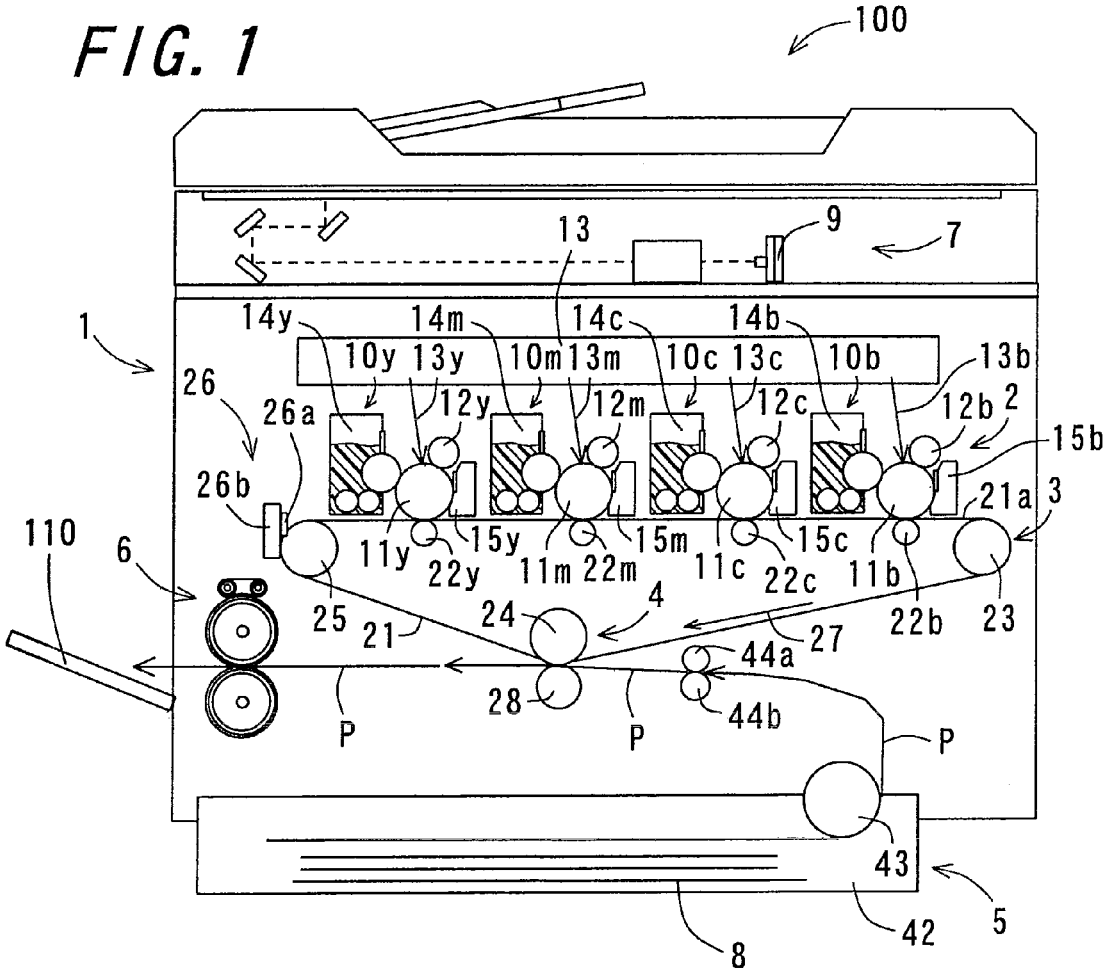
FIG. 1 is a cross sectional view schematically showing a configuration of a copier according to one embodiment of the invention.

Now referring to the drawings, preferred embodiments of the invention are described below.

Figure 2:
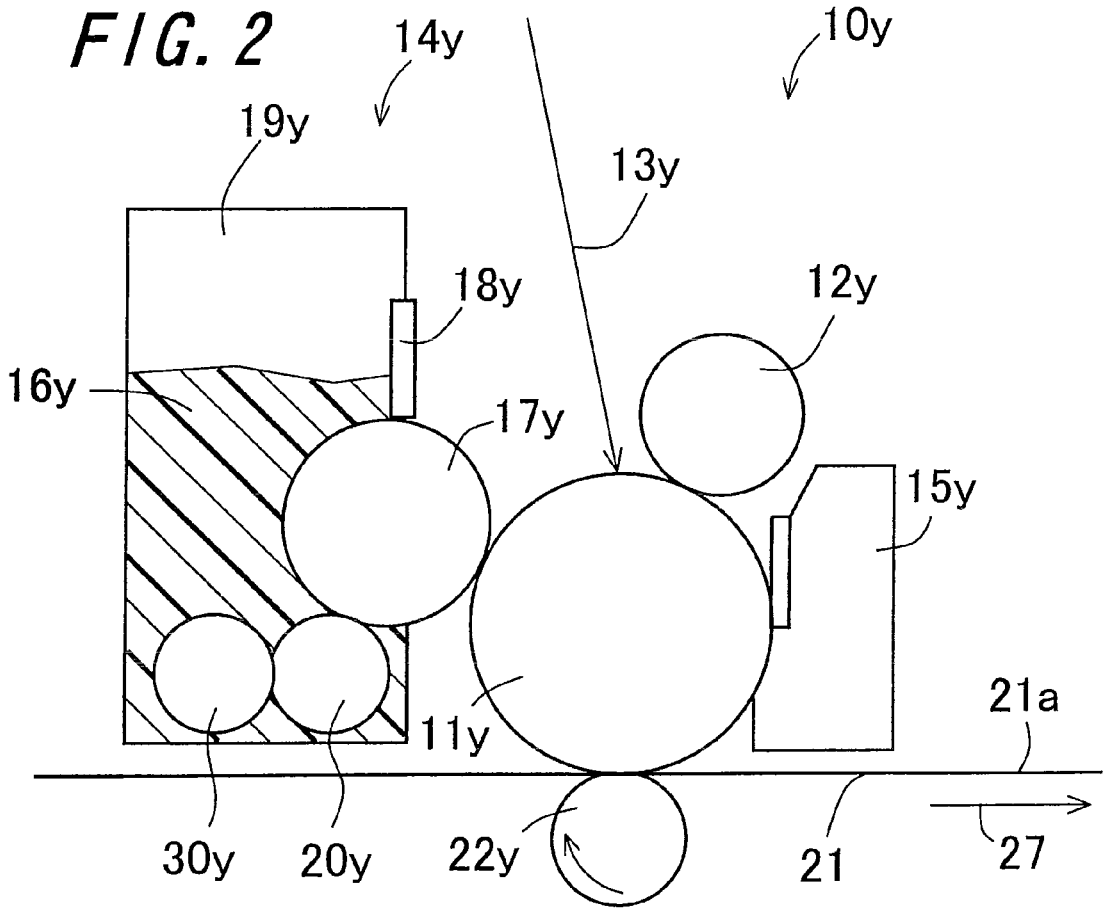
FIG. 2 is an enlarged sectional view of a configuration of a main portion (toner image forming section) of an image forming apparatus shown in FIG. 1.

FIG. 1 is a cross sectional view schematically showing a configuration of a copier 100 according to one embodiment of the invention. FIG. 2 is an enlarged sectional view of a configuration of a main portion (toner image forming section 2 described below) of an image forming apparatus 1 shown in FIG. 1.

The copier 100 includes the image forming apparatus 1 and a scanner section 7. The image forming apparatus 1 is a tandem-type electrophotographic image forming apparatus in which toner images of four colors yellow, magenta, cyan, and black are sequentially transferred and overlaid on top of one another to form a multicolor toner image and the multicolor toner image is fixed to a recording material to form an image. The image forming apparatus 1 includes a toner image forming section 2, an intermediate transfer section 3, a secondary transfer section 4, a recording material feeding section 5, and a fixing device 6.

The toner image forming section 2 includes image forming units 10*y*, 10*m*, 10*c*, and 10*b*. The image forming units 10*y*, 10*m*, 10*c*, and 10*b* are aligned in a row from an upstream side along a rotational direction (sub-scanning direction) of a later-described intermediate transfer belt 21, i.e., a direction of an arrow 27. The image forming units 10*y*, 10*m*, 10*c*, and 10*b* form toner images of the respective colors as follows. In the image forming units 10*y*, 10*m*, 10*c*, and 10*b*, electrostatic latent images are formed which correspond to image information of the respective colors inputted as digital signals, and toners of corresponding colors are then supplied to the electrostatic latent images to thereby develop the images. The image forming unit 10*y* forms a toner image corresponding to yellow image information. The image forming unit 10*m* forms a toner image corresponding to magenta image information. The image forming unit 10*c* forms a toner image corresponding to cyan image information. The image forming unit 10*b* forms a toner image corresponding to black image information. The image forming unit 10*y* includes a photoreceptor drum 11*y*, a charging roller 12*y*, a light scanning unit 13, a developing device 14*y*, and a drum cleaner 15*y*.

The photoreceptor drum 11*y* is a roller-shaped member that is supported so as to be rotatable about an axial line thereof by a driving section (not shown) and that has a photosensitive layer on which surface the electrostatic latent image and thus the toner image are formed. The usable photoreceptor drum 11*y* may be composed of a conductive substrate (not shown) and a photoreceptor drum (not shown) formed on a surface of the conductive substrate. An applicable shape of the conductive substrate may be cylindrical, columnar, sheet-like, etc., among which cylindrical is preferable. Examples of the photosensitive layer include an organic photosensitive layer and an inorganic photosensitive layer. The organic photosensitive layer may be a laminate composed of a charge generating layer which is a resin layer containing a charge generating substance, and a charge transporting layer which is a resin layer containing a charge transporting substance, or may be a resin layer which contains a charge generating substance and a charge transporting substance in a single resin layer. The inorganic photosensitive layer may be a layer which contains one or two or more of zinc oxide, selenium, amorphous silicon, and the like substance. Between the conductive substrate and the photosensitive layer may be interposed an undercoat layer, and a surface of the photosensitive layer may be provided with a surface layer (a protective layer) for protecting the photosensitive layer mainly. In the present embodiment, a 30 mm-diameter photoreceptor drum is used which contains an aluminum tube (a conductive substrate) connected to ground potential (GND) and a 20 μm-thick organic photosensitive layer formed on a surface of the aluminum tube. Further, in the embodiment, the photoreceptor drum 11*y* rotates in a clockwise direction at a peripheral velocity of 355 mm/s.

The charging roller 12*y* is a roller-shaped member which is supported so as to be rotatable about an axial line thereof by a driving section (not shown) and which charges the surface of the photoreceptor drum 11*y* with predetermined polarity and potential. The charging roller 12*y* is connected to a power source (not shown). Application of voltage by the power source to the charging roller 12*y* causes discharge of electricity to thereby charge the surface of the photoreceptor drum 11*y*. In the embodiment, voltage of −1200 V is applied to the charging roller 12*y*, and the surface of the photoreceptor drum 11*y* is thereby charged to −600 V. The charging roller 12*y* can be replaced by a brush-type charging device, a charger-type charging device, and a corona charging device such as a scorotron charger. The light scanning unit 13 irradiates the charged surface of the photoreceptor drum 11*y* with laser light 13*y* corresponding to yellow image information to thereby form on the surface of the photoreceptor drum 11*y* an electrostatic latent image corresponding to the yellow image information. For the light scanning unit 13, a semiconductor laser or the like component can be used. In the embodiment, an electrostatic latent image having an exposure potential of −70 V is formed on the surface of the photoreceptor drum 11*y* which surface has been charged to −600 V.

The developing device 14*y* includes a developing roller 17*y*, a developing blade 18*y*, a developer tank 19*y*, and stirring rollers 20*y* and 30*y*. Yellow developer 16*y* is borne on a surface of the developing roller 17*y* and supplied therefrom to the electrostatic latent image on the surface of the photoreceptor drum 11*y* at an area (named as "a developing nip portion") where the developing roller 17*y* and the photoreceptor drum 11*y* come close to each other. The developing roller 17*y* is a roller-shaped member that is supported so as to be rotatable about an axial line thereof by the developer tank 19*y* and is disposed so as to have a part thereof protrude outward from an opening formed on a surface of the developer tank 19*y* which surface faces the photoreceptor drum 11*y*, to thereby come close to the surface of the photoreceptor drum 11*y*, and that internally contains a fixed magnetic pole (not shown). The developing roller 17*y* rotates in a direction opposite to a rotational direction of the photoreceptor drum 11*y*. Accordingly, at the developing nip portion, the developing roller 17*y* and the photoreceptor drum 11*y* rotate in the same direction. Further, the developing roller 17*y* is connected to a power source (not shown) which applies DC voltage (development voltage) to the developing roller 17*y*. This causes the yellow developer 16*y* on the surface of the developing roller 17*y* to be smoothly supplied to the electrostatic latent image. In the embodiment, development voltage of −420 V is applied to the developing roller 17*y*. An yellow toner layer on the surface of the developing roller 17*y* contacts with the photoreceptor drum 11*y* at the developing nip portion where the yellow developer 16*y* is thereby supplied to the electrostatic latent image.

The developing blade 18*y* is a platy member which is provided so as to have one end supported by the developer tank 19*y* and the other end distanced away from the surface of the developing roller 17*y*. The developing blade 18*y* is used for homogenization (layer regulation) of the yellow toner layer borne on the surface of the developing roller 17*y*. The developer tank 19*y* is a container-shaped member which has the opening on the surface facing the photoreceptor drum 11*y* as described above and which has an internal space. The developer tank 19*y* contains the developing roller 17*y* and the stirring rollers 20*y* and 30*y* housed in the internal space, and stores the yellow developer 16*y* therein. The developer tank 19*y* is replenished with the yellow developer 16*y* which is supplied from a toner cartridge (not shown) according to a consumption situation of the yellow developer 16*y*.

In the embodiment, the developer tank 19 has been filled with magnetic carrier in advance. The magnetic carrier is mixed with a yellow toner supplied to the developer tank 19*y*, resulting in the yellow developer (a yellow two-component developer) 16*y*. A form of the developer is however not limited to the above form of two-component developer, and a form of one-component developer containing yellow toner only is also applicable. The stirring rollers 20*y* and 30*y* are screw-shaped members which are supported so as to be rotatable about respective axial line thereof in the internal space of the developer tank 19*y*. The stirring roller 20*y* is disposed so as to come into pressure-contact with the surface of the developing roller 17*y*. The stirring rollers 20*y* and 30*y* respectively rotate to thereby supply the yellow developer 16*y* which is supplied from the toner cartridge into the developer tank 19*y*, to a vicinity of the surface of the developing roller 17*y*.

In the developing device 14*y*, the yellow developer 16*y* which has been formed by attaching the yellow toner to the magnetic carrier in the developer tank 19*y*, is supplied by the stirring rollers 20*y* and 30*y* to the surface of the developing roller 17*y* on which a developer layer is thereby formed. A thickness of the developer layer is homogenized by the developing blade 18*y* and then, from the developer layer, the yellow developer 16*y* is selectively supplied to the electrostatic latent image on the surface of the photoreceptor drum 11*y* by using a difference in potential, resulting in a yellow toner image corresponding to the yellow image information.

The drum cleaner 15*y* removes and thus collects the yellow developer 16*y* which remains on the surface of the photoreceptor drum 11*y* after the yellow toner image has been transferred from the surface of the photoreceptor drum 11*y* to the intermediate transfer belt 21 as will hereinafter be described. In the image forming unit 10*y*, the light scanning unit 13 irradiates the surface of photoreceptor drum 11*y* which has been charged by the charging roller 12*y*, with the signal light (laser light) 13*y* corresponding to the yellow image information, thereby forming the electrostatic latent image which is then developed with the yellow developer 16*y* supplied thereto from the developing device 14*y*, with the result that the yellow toner image is formed. The yellow toner image is transferred to the intermediate transfer belt 21 which comes into pressure-contact with the surface of the photoreceptor drum 11*y* and rotates in a direction of an arrow 29 as will hereinafter be described.

The yellow developer 16*y* remaining on the surface of the photoreceptor drum 11*y* is removed and thus collected by the drum cleaner 15*y*. This image (toner image) forming operation is repeatedly carried out. The image forming units 10*m*, 10*c*, and 10*b* respectively have the configurations corresponding to the image forming unit 10*y* except that a magenta toner, a cyan toner, or a black toner is used respectively instead of the yellow toner. Descriptions of the image forming units 10*m*, 10*c*, and 10*b* will be thus omitted by denoting the same reference symbols as those in the image forming unit 10*y*, which symbols will be followed respectively by "m" indicative of magenta, "c" indicative of cyan, and "b" indicative of black.

The toner contains a binder resin, a colorant, and a release agent. As the binder resin, ingredients customarily used in this field can be used including polystyrene, a homopolymer of styrene substitute, a styrene-type copolymer, polyvinyl chloride, polyvinyl acetate, polyethylene, polypropylene, polyester, and polyurethane. The binder resins may be used each alone, or two or more thereof may be used in combination. Among the above binder resins, for the color toner, preferable is the binder resin which has a softening temperature of 100° C. to 150° C. and a glass transition temperature of 50° C. to 80° C., and particularly preferable is polyester which has a softening temperature and a glass transition temperature in the above ranges, from the aspect of storage stability, durability, etc. Polyester in a softened or fused state is high in transparency. In the case where polyester is used as the binder resin, when a multicolor toner image composed of combined toner images of yellow, magenta, cyan, and black, is fixed on a recording medium 8, the polyester itself becomes transparent, leading to sufficient color development by subtractive color mixture. As the colorant, it is possible to use pigments and dyes for toner which have been conventionally used in the electrophotographic image forming technique. Examples of the pigment include an organic pigment such as azo pigment, benzimidazolone pigment, quinacridone pigment, phthalocyanine pigment, isoindolinone pigment, isoindoline pigment, dioxazine pigment, anthraquinone pigment, perylene pigment, perynone pigment, thioindigo pigment, quinophthalone pigment, or metal complex pigment; an inorganic pigment such as carbon black, titanium oxide, molybdenum red, chrome yellow, titanium yellow, chrome oxide, or Berlin blue; and metal powder such as aluminum powder. The pigments may be used each alone, or two or more thereof may be used in combination. As the release agent, wax can be used, for example. It is possible to use the wax which is customarily used in this field including polyethylene wax, polypropylene wax, and paraffin wax. The toner may contain, other than the binder resin, colorant, and release agent, one or two or more additives for general use in toner, such as a charge control agent, a fluidity improving agent, a fixing promoting agent, and a conductive agent.

The toner can be manufactured according to the heretofore known methods such as a pulverization method, a suspension polymerization method, and an emulsification coagulation method. In the pulverizing method, the colorant, the release agent, etc. are molten and kneaded together with the binder resin, followed by pulverization. In the suspension polymerization method, the colorant, the release agent, a monomer of the binder resin, etc. are evenly dispersed, followed by polymerization of the monomer of the binder resin. In the emulsification coagulation method, binder resin particles, the colorant, the release agent, etc., are coagulated with the aid of a coagulant, and fine particles of a thus-obtained coagulated product are heated. A volume average particle diameter of the toner is not particularly limited, and a preferable diameter thereof falls in a range of from 2 μm to 7 μm. When the volume average particle diameter of the toner is less than 2 μm, the toner may be degraded in fluidity, leading to insufficient supply, stirring, and charging of the toner upon the developing operation. This may cause a shortage of the toner amount, an increase of toner of reverse polarity, and the like problem, which possibly leads to a failure in forming high-quality images. When the volume average particle diameter of the toner exceeds 7 μm, a larger amount of the toner particles has such a large diameter that a center part of each toner particle is hard to be soften, with the result that a fixing property of the image onto the recording medium 8 is degraded and moreover, the color development of the image is lower. And particularly in the case of fixing the image onto an OHP sheet, an obtained image is darker.

In the embodiment, the toner except the pigment has the same configuration as follows. The toner is a negatively-charged nonmagnetic insulating toner which has a glass transition temperature of 60° C., a softening temperature of 120° C., and a volume average particle diameter of 6 μm. When using the toner to obtain an image having an image density of 1.4 measured through a 310 reflection densitometer manufactured by X-Rite, incorporated, a required toner amount is 5 g/m$^2$. The toner contains polyester (the binder resin) having a glass transition temperature of 60° C. and a softening temperature of 120° C., a low-molecular polyethylene wax (the release agent) having a glass transition temperature of 50° C. and a softening temperature of 70° C., and pigments of respective colors. A content of the wax is 7% by weight of the total amount of the toner while a content of the pigment is 12% by weight of the total amount of the toner, with the binder resin, i.e., polyester which occupies a remaining part of the total amount of the toner. The low-molecular polyethylene wax contained in the toner is wax whose glass transition temperature and softening temperature are lower than those of the polyester serving as the binder resin.

The intermediate transfer section 3 includes the intermediate transfer belt 21, intermediate transfer rollers 22*y*, 22*m*, 22*c*, and 22*b*, supporting rollers 23, 24, and 25, and a belt cleaner 26. The intermediate transfer belt 21 is an endless belt-shaped toner image bearing member which is supported around the supporting rollers 23, 24, and 25 with tension to form a loop-like travel path. The intermediate transfer belt 21 rotates in the direction of the arrow 27 at a velocity which is substantially the same as those of the photoreceptor drums 11*y*, 11*m*, 11*c*, and 11*b*. For the intermediate transfer belt 21, a 100 μm-thick polyimide film can be used, for example. A material of the intermediate transfer belt 21 is not limited to polyimide, and it is possible to use a film made of synthetic resin such as polycarbonate, polyamide, polyester, and polypropylene, or a film made of various rubbers. In the film made of the synthetic resin or the various rubbers, a conductive material such as furnace black, thermal black; channel black, or graphite carbon, is blended in order to adjust an electric resistance value of the intermediate transfer belt 21. A toner image bearing surface 21*a* of the intermediate transfer belt 21 comes into pressure-contact with the photoreceptor drums 11*y*, 11*m*, 11*c*, and 11*b* in the order just stated from the upstream side in the rotational direction of the intermediate transfer belt 21. Positions where the intermediate transfer belt 21 comes into pressure-contact with the photoreceptor drums 11*y*, 11*m*, 11*c*, and 11*b*, are positions where toner images of respective colors are transferred. The intermediate transfer rollers 22*y*, 22*m*, 22*c*, and 22*b* are arranged at positions which are respectively opposed to the photoreceptor drums 11*y*, 11*m*, 11*c*, and 11*b* with the intermediate transfer belt 21 interposed therebetween.

The intermediate transfer rollers 22*y*, 22*m*, 22*c*, and 22*b* are roller-shaped members which are respectively opposed to the photoreceptor drums 11*y*, 11*m*, 11*c*, and 11*b* with the intermediate transfer belt 21 interposed therebetween and come into pressure-contact with a reverse side of the toner image bearing surface 21*a* of the intermediate transfer belt 21 and which are disposed so as to be rotatable about respective axial line of the rollers by a driving section (not shown). For each of the intermediate transfer rollers 22*y*, 22*m*, 22*c*, and 22*b*, a roller-shaped member is used, for example, which is composed of a metallic shaft and a conductive layer covering a surface of the metallic shaft. The shaft is, for example, formed of a metal such as stainless steel. A diameter of the shaft is not particularly limited, and preferably from 8 mm to 10 mm. The conductive layer is formed of a conductive elastic body or the like material. As the conductive elastic body, a material customarily used in this field is applicable including, for example, ethylene-propylene-diene rubber (EPDM), foamed EPDM, and urethane foam, which contain a conductive material such as carbon black. Owing to the conductive layer, high voltage is evenly applied to the intermediate transfer belt 21. Since the toner images formed on the surfaces of the photoreceptor drum 11*y*, 11*m*, 11*c*, and 11*b* are transferred onto the intermediate transfer belt 21, intermediate transfer bias is applied to the intermediate transfer rollers 22*y*, 22*m*, 22*c*, and 22*b* through a constant voltage control, which bias has a polarity reverse to that of the polarity of the charged toner. By so doing, the toner images of yellow, magenta, cyan, and black formed on the photoreceptor drums 11*y*, 11*m*, 11*c*, and 11*b* are sequentially transferred and overlaid on top of one another on the toner image bearing surface 21*a* of the intermediate transfer belt 21, thus forming a multicolor toner image. Note that in the case where image information of only part of yellow, magenta, cyan, and black is inputted, a toner image is formed by only an image forming unit corresponding to a color of inputted image information, among the image forming units 10*y*, 10*m*, 10*c*, and 10*b*.

The supporting rollers 23, 24, and 25 are disposed so as to be rotatable about respective shaft centers thereof by a driving section (not shown). The intermediate transfer belt 21 is stretched out and rotated in the direction of the arrow 27 by the supporting rollers 23, 24, and 25. For each of the supporting rollers 23, 24, and 25, an aluminum-made cylinder (a pipe-shaped roller) is used, for example, having a diameter of 30 mm and a thickness of 1 mm. The supporting roller 24 comes into pressure-contact with a later-described secondary transfer roller 28 with the intermediate transfer belt 21 interposed therebetween, thus forming a secondary transfer nip portion, and is electrically grounded. The supporting roller 24 has a function of stretching out the intermediate transfer belt 21 together with a function of secondarily transferring the toner image on the intermediate transfer belt 21 onto the recording medium 8.

The belt cleaner 26 is disposed opposite to the supporting roller 25 with the intermediate transfer belt 21 interposed therebetween. The belt cleaner 26 includes a cleaning blade 26*a* and a toner storing container 26*b*. The cleaning blade 26*a* is a platy member which comes into pressure-contact with the toner image bearing surface 21*a* of the intermediate transfer belt 21 by a blade pressure section (not shown) and scrapes off the residual toner, etc. on the toner image bearing surface 21*a*.

As the cleaning blade 26*a*, it is possible to use a blade made of a rubber material (e.g. urethane rubber) having elasticity, for example. The toner storing container 26*b* serves to temporarily store the toner etc. scraped off by the cleaning blade 26*a*.

In the intermediate transfer section 3, the toner images formed on the photoreceptor drums 11*y*, 11*m*, 11*c*, and 11*b* are transferred and thus overlaid on top of one another at predetermined positions on the toner image bearing surface 21*a* of the intermediate transfer belt 21, thus forming a toner image. The toner image is secondarily transferred onto the recording medium 8 in the secondary transfer nip portion as described later. The toner, offset toner, paper dust, etc. which remain on the toner image bearing surface 21*a* of the intermediate transfer belt 21 after the secondarily-transferring operation, are removed by the belt cleaner 26. And onto the toner image bearing surface 21*a*, a toner image is transferred again.

The secondary transfer section 4 includes the supporting roller 24 and the secondary transfer roller 28. The secondary transfer roller 28 is a roller-shaped member that is brought into pressure-contact with the supporting roller 24 through the intermediate transfer belt 21, is provided to be driven rotatably around an axis direction, and is rotationally driven by a driving section (not shown). For example, the secondary transfer roller 28 is comprised of a metal-made shaft body and a conductive layer covering the surface of the metal-made shaft body. The metal-made shaft body is made of a metal such as stainless steel, for example. The conductive layer is made of a conductive elastic element or the like. As the conductive elastic element, those commonly used in this field are usable, and examples thereof include EPDM, foamed EPDM, and foamed urethane that contain a conductive agent such as carbon black. The secondary transfer roller 28 is connected to a not-shown power source, to which a high voltage having a polarity opposite to the charging polarity of toner is uniformly applied. A pressure-contact region among the supporting roller 24, the intermediate transfer belt 21, and the secondary transfer roller 28 is a secondary transfer nip portion. In the secondary transfer section 4, the toner image on the intermediate transfer belt 21 is transported to the secondary transfer nip portion, and in synchronization therewith, the recording material 8 that is fed from the recording material feeding section 5 described below is transported to the secondary transfer nip portion, and the toner image and the recording material 8 are overlaid at the secondary transfer nip portion so that the toner image is secondarily transferred to the recording material 8. In this manner, an unfixed toner image is borne on the recording material 8. The recording material 8 that bears the unfixed toner image is transported to the fixing device 6. The fixing device 6 heats and fuses the toner constituting the unfixed toner image borne on the recording material 8 to fix on the recording material 8. A detailed configuration of the fixing device 6 will be described below. The recoding material 8 to which the toner image has been fixed is discharged to a discharge tray 110 and image formation is completed.

The recording material feeding section 5 includes a recording medium cassette 42, a pickup roller 43, and registration rollers 44*a* and 44*b*. The recording medium cassette 42 stores the recording medium 8. Specific examples of the recording medium 8 include plain paper, coated paper, paper only for color copy, a film for OHP (overhead projector), and a post card. Size of the recording medium 8 includes A4, A3, B5, B4, and a postcard size. The pickup roller 43 feeds the recording medium 8 sheet by sheet to a conveyance path P. The registration rollers 44*a* and 44*b* are a pair of roller members which are disposed in pressure-contact with each other, and serve to feed the recording medium 8 to the secondary transfer nip portion in synchronization with conveyance of the multicolor toner image on the intermediate transfer belt 21 to the secondary transfer nip portion. In the recording material feeding section 5, the recording medium 8 stored inside the recording medium cassette 42 is fed sheet by sheet to the conveyance path P by the pickup roller 43, and furthermore fed to the secondary transfer nip portion by the registration rollers 44*a* and 44*b*.

The scanner section 7 includes a document table, a light source (not illustrated), and a CCD (charge coupled device) image sensor 9. On an upper face of the document table, a to-be-copied document is placed. A plate-shaped member made of a transparent material such as transparent glass is used for the document table. The light source illuminates the document placed on the document table. The CCD image sensor 9 photoelectrically converts light reflected from the document illuminated by the light source, thereby converting the reflected light to image data (image signals) The CCD image sensor 9 includes a converting portion, a transfer portion and an output portion. The converting portion converts light signals of the reflection light to electric signals. The transfer portion sequentially transfers the electric signals to the output portion in synchronism with clock pulses. The output portion converts the electric signals to voltage signals, amplifies the voltage signals, makes the signals low-impedance, and outputs the signals. The analog signals obtained in this manner are converted into digital signals by well-known image processing. The image data of the document read by the scanner section 7 is sent to a control unit for controlling all operations of the image forming apparatus, where the image date is subjected to the various image processes. And thereafter, the image date is temporarily stored in a memory. In response to an output command, the image stored in the memory is read out and transferred to the light scanning unit 13, whereby the image is formed on a recording sheet of the recording medium 8.

The image forming apparatus 1 is provided with a control unit (not shown). The control unit is disposed in an upper part of internal space of the image forming apparatus 1. The control unit includes a memory portion, a computing portion, and a control portion, which are not shown. In the memory portion are written, for example, a print command inputted by way of an operation panel (not shown) disposed on the top surface of the image forming apparatus 1, a result detected by various sensors (not shown) disposed in various parts inside the image forming apparatus 1, image information inputted from an external equipment, various set values and data table which are used to control the operations of various components inside the image forming apparatus 1, and a program for performing the various controls. For the memory portion, a device customarily used in this field can be used including, for example, a read only memory (ROM), a random access memory (RAM), and a hard disc drive (HDD). For the external equipment, an electrical and electronic equipment can be used which can form or obtain image information and which can be electrically connected to the image forming apparatus 1. Specific examples of the external equipment include a computer and a digital camera. The computing portion takes out the various data (the print command, the detected result, the image information, etc.) inputted in the memory portion, and the program for performing the various controls. On the basis of the above various data and program, the computing portion conducts various detection and/or determination. According to various results of determination and computational decisions obtained by the computing nortion, the control portion sends a control signal to a relevant device to control an operation thereof. The control portion and the computing portion are, for example, process circuits which are realized by a microcomputer, a microprocessor, etc. having a central processing unit (CPU). The control unit includes a main power source together with the memory portion, the computing portion, and the control portion. The main power source supplies electric power to not only the control unit but also the various devices inside the image forming unit 1.

Figure 3:
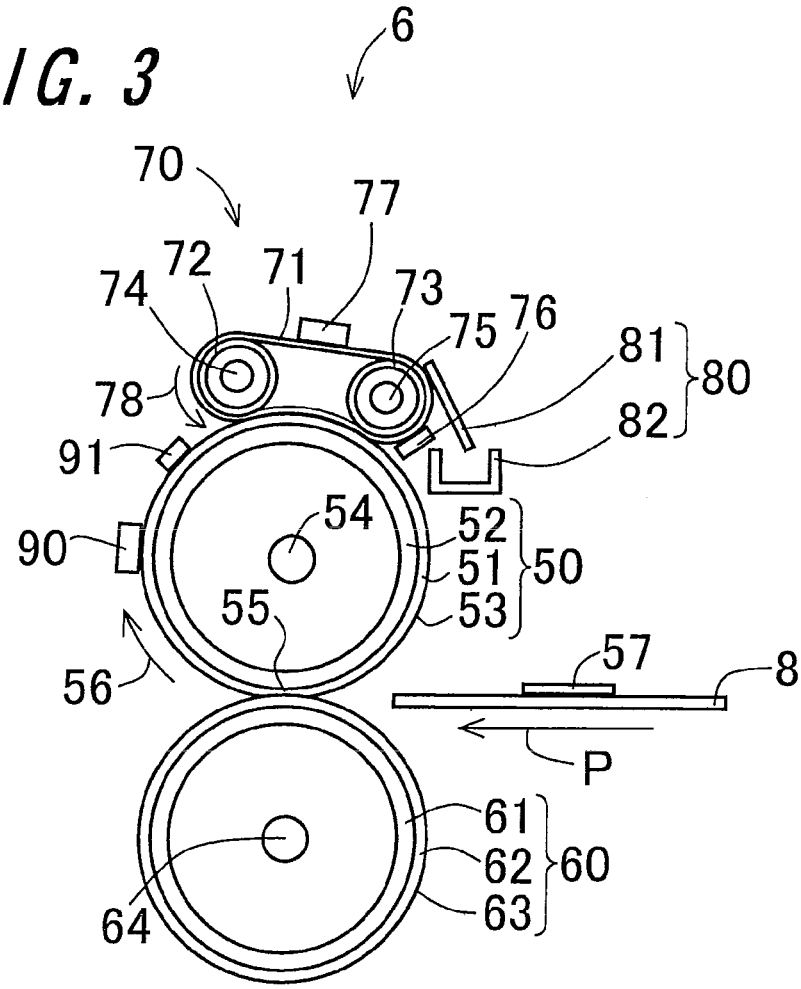
FIG. 3 is a cross sectional view schematically showing a configuration of a fixing device according to an embodiment of the invention.

FIG. 3 is a cross sectional view schematically showing a configuration of the fixing device 6 according to an embodiment of the invention. Referring to FIG. 3, the configuration of the fixing device 6 according to the embodiment of the invention will be described in detail. As shown in FIG. 3, the fixing device 6 includes a fixing roller 50, a pressure roller 60, an external heating section 70, and a cleaning section 80.

The fixing roller 50 is a fixing section of a roller-shaped member that is supported by a supporting section (not shown) so as to rotate freely and rotates at a predetermined speed in a direction indicated by an arrow 56 by a driving section (not shown). The fixing roller 50 heats and fuses the toner constituting the unfixed toner image borne on the recording material 8. In this embodiment, used as the fixing roller 50 is a roller-shaped member composed of a metal core 52, an elastic layer 51, and a surface layer 53. A metal having high thermal conductivity is usable as a metal forming the metal core 52 and examples thereof include aluminum and iron. Examples of the shape of the metal core 52 include a cylindrical shape and a columnar shape, and the cylindrical shape that discharges a smaller amount of heat from the metal core 52 is preferable. As a material constituting the elastic layer 51, any material having rubber elasticity is used without particular limitation, and preferably used is a material also excellent in heat resistance. Specific examples of such a material include silicone rubber, fluoro-rubber, and fluorosilicone rubber. Among them, the silicone rubber particularly excellent in rubber elasticity is preferable. As a material constituting the surface layer 53, any material is used without particular limitation as long as the material has excellent heat resistance and durability, and weak adherence to toner, and examples thereof include a fluorine resin material such as PFA (tetrafluoroethylene-perfluoroalkylvinylether copolymer) and PTFE (polytetrafluoroethylene), and a fluoro-rubber. In this embodiment, the surface layer 53 is a PFA layer having thickness of about 40 μm. In this embodiment, a roller-shaped member having a diameter of 40 mm is used as the fixing roller 50. Inside the fixing roller 50, a heating section 54 is provided. This aims to shorten a start-up time of the image forming apparatus 1 after turning on the power source until a state ready for image formation is set, to heat the fixing roller 50 uniformly during a stand-by state, and to prevent the surface temperature of the fixing roller 50 from lowering due to heat transfer to the recording material 8 in fixing the toner image. In this embodiment, a halogen lamp is used as the heating section 54.

The fixing roller 50 includes a thermistor 90 and a thermostat 91. The thermistor 90 is provided close to the fixing roller 50 and detects the temperature of the fixing roller 50. A detection result by the thermistor 90 is inputted to the CPU. Based on the detection result by the thermistor 90, the CPU determines whether or not the temperature of the fixing roller 50 falls within a set range. When the temperature of the fixing roller 50 is lower than the set range, a control signal is sent to the power source connected to the heating section 54, and electric power is supplied to the heating section 54, thus promoting to generate heat. When the temperature of the fixing roller 50 is higher than the set range, the absence or presence of the power feeding capability to the heating section 54 is confirmed. When the power supply continues, a control signal for stopping the power supply is sent by the thermostat 91. In accordance with the detection result by the thermistor 90, the power supply from the power source connected to the heating section 54 is started or stopped. The heating section 64 described below in the pressure roller 60 may be controlled by the thermistor 90 and the thermostat 91 or may be controlled by additionally installing a thermistor and a thermostat in the pressure roller 60.

The pressure roller 60 is a roller-shaped member which is disposed so as to be rotatable in pressure-contact with the fixing roller 50 by a pressurizing mechanism, in downstream of the lowest point in a vertical direction of the fixing roller 50 in a rotational direction of the fixing roller 50. A pressure-contact region between the fixing roller 50 and the pressure roller 60 is a fixing nip portion 55. The pressure roller 60 is driven to rotate by rotation of the fixing roller 50. The pressure roller 60 performs heat-fixing of the toner image onto the recording medium 8 in cooperation with the fixing roller 50. At this time, the pressure roller 60 presses the fused toner onto the recording medium 8 to thereby promote the fixing of the toner image onto the recording medium 8. In the embodiment, as the pressure roller 60, a roller-shaped member having a diameter of 40 mm is used which is composed of a metal core 61, an elastic layer 62, and a surface layer 63. Usable materials for forming the metal core 61, the elastic layer 62, and the surface layer 63 are respectively the same metal or material which forms the metal core 52, elastic layer 51, and surface layer 53 of the fixing roller 50. Further, a shape of the metal core 61 is also the same as that in the case of the metal core 52 of the fixing roller 50. Inside the pressure roller 60, a heating portion 64 is provided. This aims to shorten the start-up time of the image forming apparatus 1 after turning on the power source thereof until the state ready for image formation is set, and prevent a surface temperature of the fixing roller 60 from drastically lowering which is caused by heat transfer to the recording medium 8 in fixing the toner image. In the embodiment, a halogen lamp is used for the heating portion 64.

The external heating section 70 includes an external heating belt 71, a first pressure-contact roller 72, a second pressure-contact roller 73, a thermistor 76 which is a detecting section, and a thermostat 77. The external heating belt 71 is an endless belt-shaped member that is supported around the first pressure-contact roller 72 and the second pressure-contact roller 73 with tension to form a loop-shaped movement path. Further, the external heating belt 71 is provided to make contact with the fixing roller 50 in a band-shaped area that extends along a longitudinal direction of the fixing roller 50 over a length in an outer circumferential direction of the fixing roller 50 from a pressure-contact point between the first pressure-contact roller 72 and the fixing roller 50 to a pressure-contact point between the second pressure-contact roller 73 and the fixing roller 50. In addition, the external heating belt 71 is driven to rotate in a direction indicated by an arrow 78 by rotational driving of the fixing roller 50 in a direction indicated by the arrow 56. As the external heating belt 71, any belt that is excellent in heat-resistance and durability may be used. Moreover, a belt that has higher adherence to toner than on the surface of the fixing roller 50 is selected so as to allow the offset toner adhering to the fixing roller 50 to be collected by the external heating belt 71. Examples thereof include a polyimide-made external heating belt and an electroformed nickel external heating belt. Used in this embodiment is an endless belt having thickness of 100 μm that is formed into a cylindrical shape having a diameter of 31 mm.

The first pressure-contact roller 72 and the second pressure-contact roller 73 are roller-shaped members which are rotatably supported and disposed so as to come into pressure-contact with a surface of the fixing roller 50 with the external heating belt 71 interposed therebetween. The first pressure-contact roller 72 and the second pressure-contact roller 73 are driven to rotate by rotation of the external heating belt 71 in the direction of the arrow 78. As the first pressure-contact roller 72 and the second pressure-contact roller 73, metallic rollers can be used, each of which is made of a metal having high thermal conductivity such as aluminum and iron. On a surface of the metallic roller, a fluorine resin layer may be formed according to need. The first pressure-contact roller 72 and the second pressure-contact roller 73 contain therein heating portions 74 and 75, respectively. These heating portions heat the external heating belt 71 and thus the fixing roller 50. The heating portions 74 and 75 are connected to a power source (not shown), and electric power is supplied to cause the heating portions 74 and 75 to generate heat. As the heating portions 74 and 75, a commonly-used heating device can be used. In the embodiment, a halogen lamp is used for each of heating portions 74 and 75. Note that the first pressure-contact roller 72 and the second pressure-contact roller 73 are disposed so as to have respective axial lines thereof in parallel with each other on the fixing roller 50 and so as to be distanced away from each other. The thermistor 76 detects the temperature of the external heating belt 71 and the detection result is inputted to the CPU. Like the thermostat 91, the thermostat 77 controls the temperature of the external heating belt 71 based on the temperature detected by the thermistor 76.

A fixing mechanism containing the fixing roller 50, the pressure roller 60, and the external heating section 70 is controlled by the control unit (not shown) which controls an entire operation of the image forming apparatus 1. In response to an input of command for image formation, the control unit sends a control signal to the power source (not shown) for supplying electric power to the heating portions 54, 64, 74, and 75 which are provided respectively inside the fixing roller 50, the pressure roller 60, the first pressure-contact roller 72 and the second pressure-contact roller 73. The command for image formation is inputted from an operation panel (not shown) which is disposed on a top surface in a vertical direction of the image forming apparatus 1, or an external equipment such as a computer which is connected to the image forming apparatus 1. The power source which has received the control signal, supplies electric power to activate the heating portions 54, 64, 74, and 75. The heating portions 54, 64, 74, and 75 respectively heat the heating roller 50, the pressure roller 60, and the surface of the external heating belt 71, up to the respective set temperatures. A temperature detecting sensor (not shown) is disposed near the thermistor 90 and the pressure roller 60, and detects that temperatures of the above components have reached the set temperatures. An input of such a detected result to the control unit causes the control unit to send a control signal to a driving section (not shown) for rotating the fixing roller 50, thereby driving the fixing roller 50 to rotate in the direction of the arrow 56. This also drives the pressure roller 60 and thus the external heating belt 71. In this state, the recording medium 8 bearing the unfixed toner image is conveyed from the secondary transfer section 4 to the fixing nip portion 55. When the recording medium 8 passes through the fixing nip portion 55, the toner constituting the toner image is heated and pressurized to be thereby fixed on the recording medium 8, with the resulting that an image is formed.

The cleaning section 80 includes a scraper 81 and a toner collecting box 82 which is a toner collecting section, and removes offset toner and paper dust adhering to the external heating belt 71. The scraper 81 being brought into contact with the surface of the external heating belt 71 scrapes the surface of the external heating belt 71 at the fixing process and causes the peeled toner and the like to be adhered thereto and be reserved. The toner collecting box 82 is arranged below the scraper 81. With vibration caused by the contact/separation operation of the external heating section 70 with respect to the fixing roller 50, which will be described below, the toner and the like peeled from the scraper 81 are collected in the toner collecting box 82.

As a material of the scraper 81, any material having heat resistance to which vibration generated in the contact/separation operation is easily transferred is applicable without limitation. An SUS having thickness of 100 μm is used in this embodiment. The toner collecting box 82 has a recessed cross section as shown in FIG. 3 so that dropped toner and the like do not adhere to the fixing roller 50 and the pressure roller 60. As a material of the toner collecting box 82, any material having heat resistance is applicable, and an example thereof includes a metal such as aluminum or a resin such as a plastic.

Figure 4:
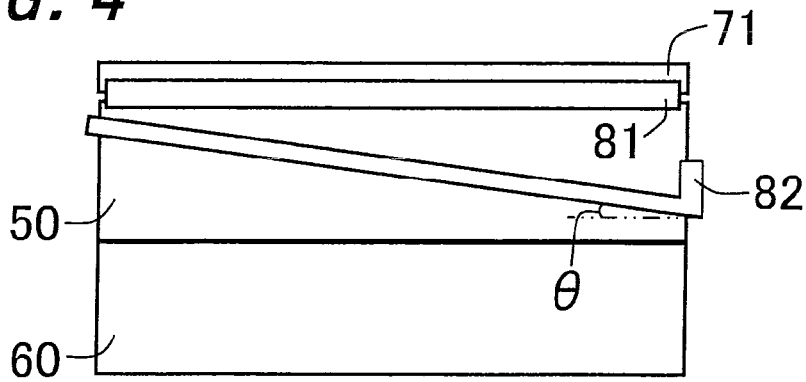
FIG. 4 is a side view showing positions of a scraper and a toner collecting box.

FIG. 4 is a side view showing positions of the scraper 81 and the toner collecting box 82. Since toner and the like peeled from the scraper 81 are reserved in the edge of the collecting box (contamination is reserved on the right side in FIG. 4) by inclining the bottom face of the toner collecting box 82 in an axis direction of the fixing roller 50 or the like, a service man can remove easily. An inclination angle 0 of the bottom face in the horizontal direction at this time is preferably around 10°.

Figure 5A:
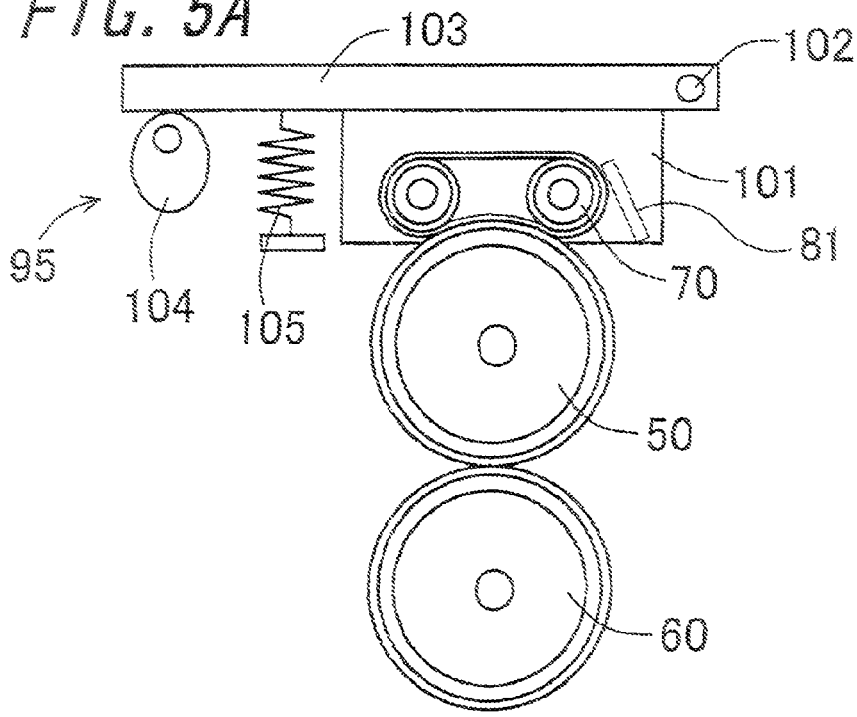
FIGS. 5A and 5B are cross sectional views schematically showing a configuration of a first contact/separation section adapted to contact/separate an external heating section with respect to a fixing roller.
Figure 5B:
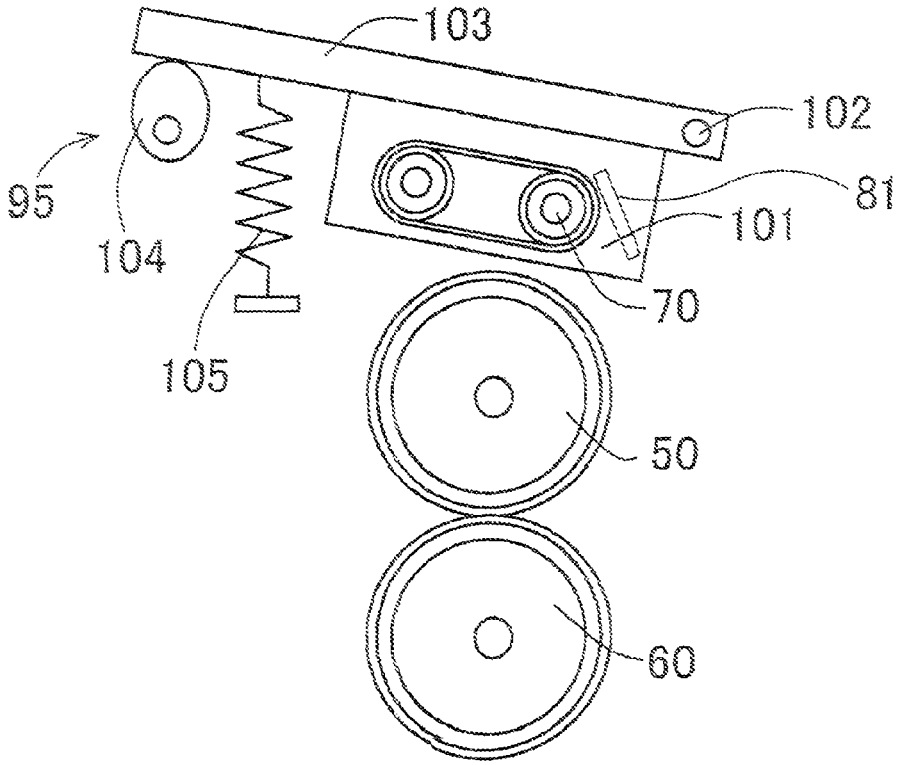

FIGS. 5A and 5B show a first contact/separation section 95 adapted to contact/separate the external heating section 70 with respect to the fixing roller 50, where the cleaning section 80 is omitted. The first contact/separation section 95 is a member that contacts/separates the external heating section 70 with respect to the fixing roller 50 to control the temperature of the fixing roller more accurately, and serves as a vibration applying section adapted to peel the toner and the like by applying vibration to the scraper 81. The first contact/separation section 95 includes a sheet metal 101, a spindle 102, an arm 103, the eccentric cam 104 and a spring 105. FIG. 5A shows a state where the pressure-contact rollers 72 and 73, and the external heating belt 71 are brought into contact with the fixing roller 50, and FIG. 5B shows a state where the pressure-contact rollers 72 and 73, and the external heating belt 71 are separated from the fixing roller 50. Both ends of the pressure-contact rollers 72 and 73 are supported by a sheet metal 101 through bearings (not shown) and the like. Two sheet metals, which are not shown, are arranged so as to sandwich the pressure-contact rollers 72 and 73 therebetween. The sheet metal 101 is fixed to an arm 103. The arm 103 is kept by a not-shown frame of the fixing device and a spindle 102, to which a load is applied by a spring 105 in a direction to be in contact with the fixing roller 50 with the spindle 102 as a fulcrum. In this embodiment, an SUS is used as a material of the spring 105, and a spring constant thereof is 0.71 kgf/mm. Rotation of an eccentric cam 104 allows the arm 103 to be angularly displaced with the spindle 102 as an axis and to move away from or contact with the fixing roller 50. In linkage with the movement of the arm 103, the pressure-contact rollers 72 and 73, and the external heating belt 71 are capable of performing the contact/separation operation of contacting with or releasing pressure to the fixing roller 50. The rotation of the eccentric cam 104 is enabled by rotation from a motor (not shown). In this embodiment, the weight of the whole external heating section 70 is about 360 g, and the rotation of the motor is controlled so that speed of the external heating section 70 in contact is 100 mm/sec to apply sufficient vibration to the scraper 81.

Next, description will be given for an operation of the fixing device 6 of the invention performed until rotation of the fixing roller 50 is started after turning on the power source, with reference to a flowchart of FIG. 6.

When the power source is turned on or restoring from a power-saving mode, the image forming apparatus 1 starts an operation (S1). The power-saving mode here shows a state where the CPU is energized but no electric power is supplied to all of the heating sections 54, 64, 74, and 75. The surface temperature of the fixing roller 50 is detected by the thermistor 90 (S2). Whether the temperature detected at S2 is less than a set temperature or not less than the set temperature is determined (S3). The set temperature is temperature sufficient for fixing unfixed toner to the recording material 8. When the detected temperature is less than the set temperature, the fixing roller 50 is heated (S4). The heating is performed by the heating section 54 inside the fixing roller 50 and the external heating section 70. When the detected temperature is not less than the set temperature, the fixing roller 50 is not heated. At this time, when the fixing roller 50 is abnormally heated, for example, natural cooling or cooling by a cooling section may be performed. The operations similar to the operations from S1 to S4 are also performed in the pressure roller 60. Whether each detected temperature of the fixing roller 50 and the pressure roller 60 reaches each set temperature is determined (S5). In the case of not reaching the set temperature, the procedure returns to S3. When both the fixing roller 50 and the pressure roller 60 reach the set temperature, rotational driving of the fixing roller 50 is started, followed by that the pressure roller 60 is started to be driven to rotate (S6).

Figure 7:
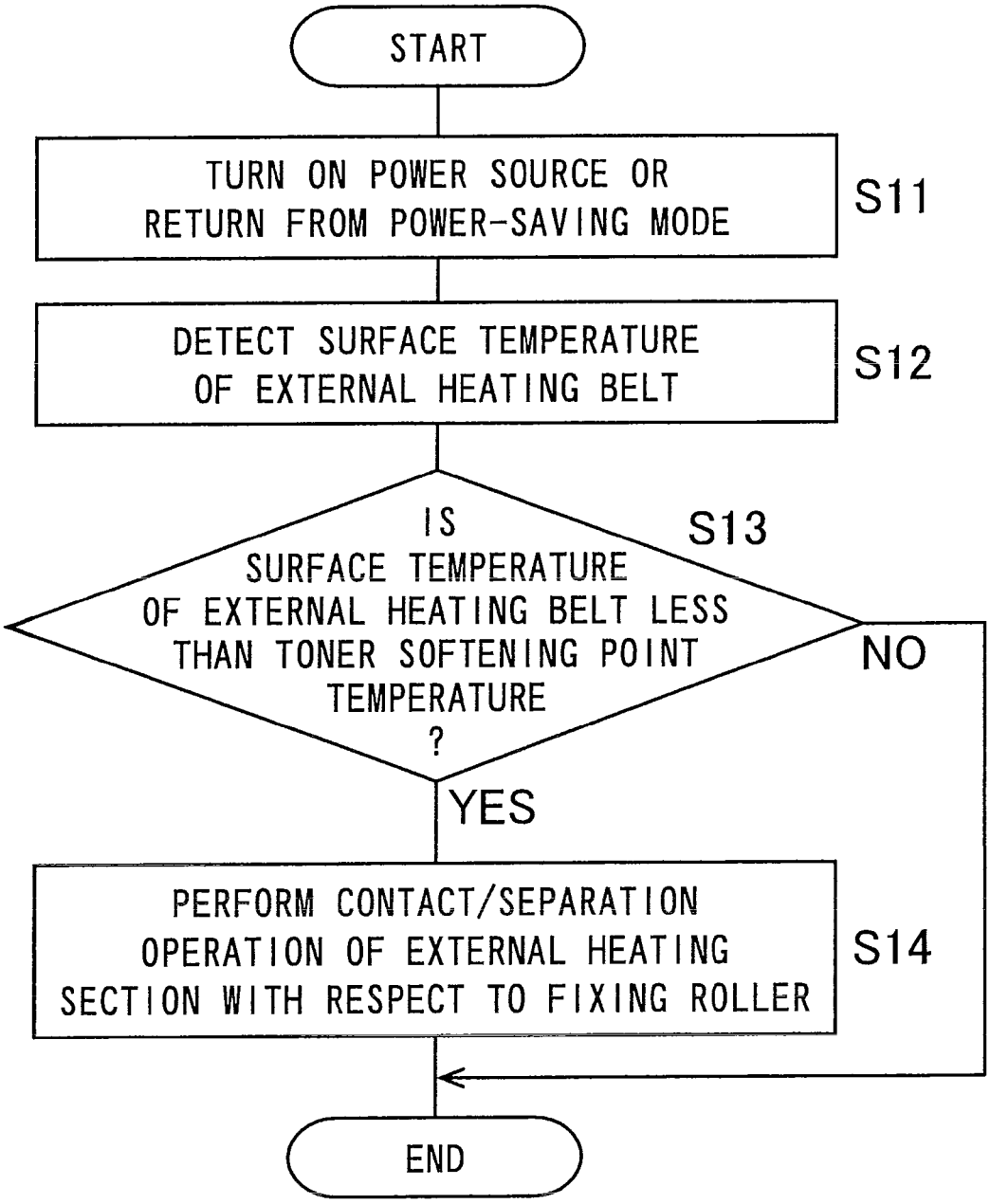
FIG. 7 is a flowchart showing an operation of the fixing device performed until a contact/separation operation of the external heating section is finished after turning on a power source.

Next, description will be given for an operation of the fixing device 6 of the invention performed until a contact/separation operation of the external heating section 70 is finished after turning on the power source, with reference to a flowchart of FIG. 7.

When the power source is turned on or restoring from a power-saving mode, the image forming apparatus 1 starts an operation (S11). The power-saving mode here shows a state where the CPU is energized but no electric power is supplied to all of the heating sections 54, 64, 74, and 75. The thermistor 76 detects the surface temperature of the external heating belt 71 of the external heating section 70 (S12). Whether the surface temperature is less than a softening temperature of toner or not less than the softening temperature of toner is determined by the CPU (S13). In this embodiment, the softening temperature of toner is about 120° C. When the surface temperature is less than the softening temperature of toner, the first contact/separation section 95 performs a contact/separation operation of the external heating section 70 with respect to the fixing roller 50 (S14). The contact/separation operation may be performed only once or a plurality of times. With the contact/separation operation, vibration is applied to the scraper 81. Since the toner and the like scraped from the external heating belt 71 adhere to the scraper 81 due to rotation of the pressure-contact rollers 72 and 73, and the external heating belt 71 before the contact/separation operation is performed, the toner and the like are peeled off when the vibration is applied to the scraper 81, and then collected in the toner collecting box 82 arranged below the scraper 81. When the surface temperature of the external heating belt 71 is not less than the softening temperature of toner, the contact/separation operation is not performed. The reason for not performing the contact/separation operation is that, when the surface temperature is less than the softening temperature of toner, the viscosity of the adhering toner decreases and the toner and the like are easily peeled from the scraper 81 due to the vibration caused in the contact/separation operation, however, in the case of being not less than the softening temperature of toner, the viscosity of the adhering toner increases and is not completely peeled from the scraper 81 even when the vibration is applied.

Figure 6:
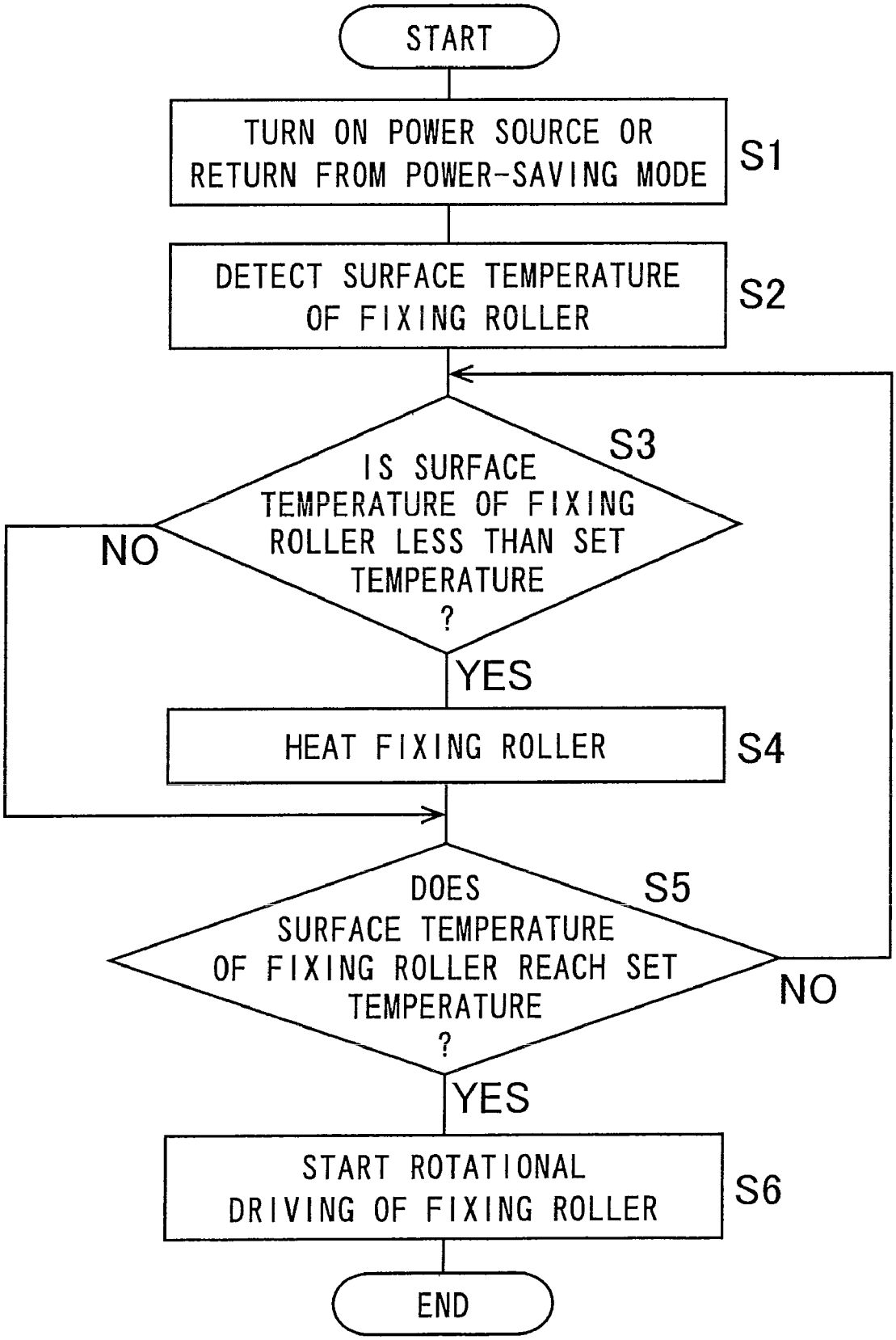
FIG. 6 is a flowchart showing an operation of the fixing device performed until rotation of the fixing roller is started after turning on a power source.

The operation of heating the fixing roller 50 and the pressure roller 60 shown in FIG. 6 and the operation of contacting/separating the external heating section 70 with/from the fixing roller 50 are independent and individual operations. That is, the operations may be performed simultaneously or one of the operations may be performed after the other operation is finished. After both the operations are finished, the recording material 8 is transported to the fixing device 6 to start the fixing processing.

Next, description will be given for the fixing device 6 that applies vibration to the scraper 81 by contact/separation of the pressure roller 60 according to another embodiment of the invention. In this case also, the mechanisms shown in FIGS. 1 to 4 have the same mechanisms. Moreover, the operation shown in FIG. 6 is performed in the same manner.

Figure 8A:
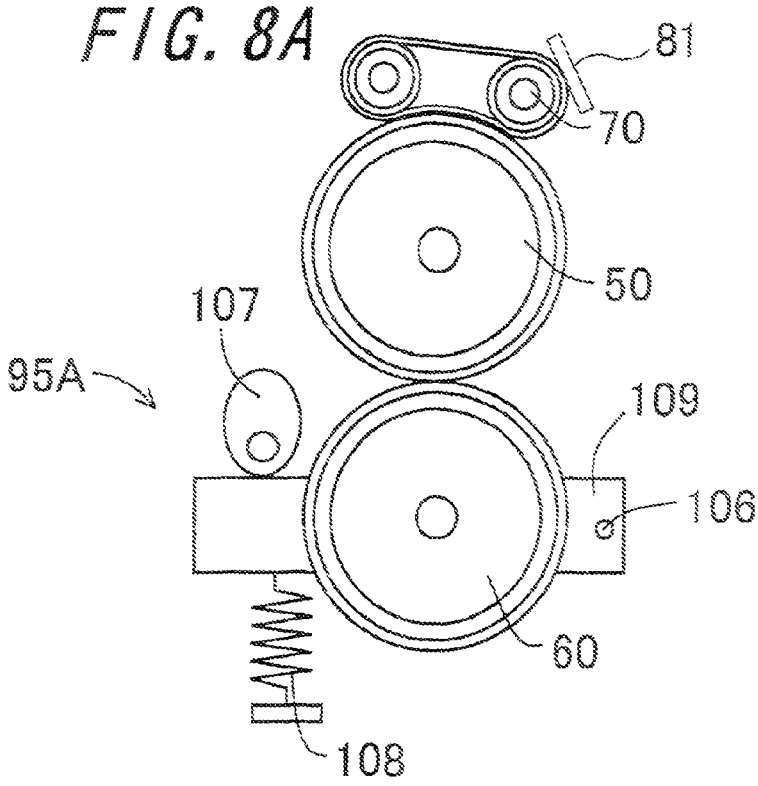
FIGS. 8A and 8B are cross sectional views schematically showing a configuration of a second contact/separation section adapted to contact/separate a pressure roller with respect to a fixing roller.
Figure 8B:
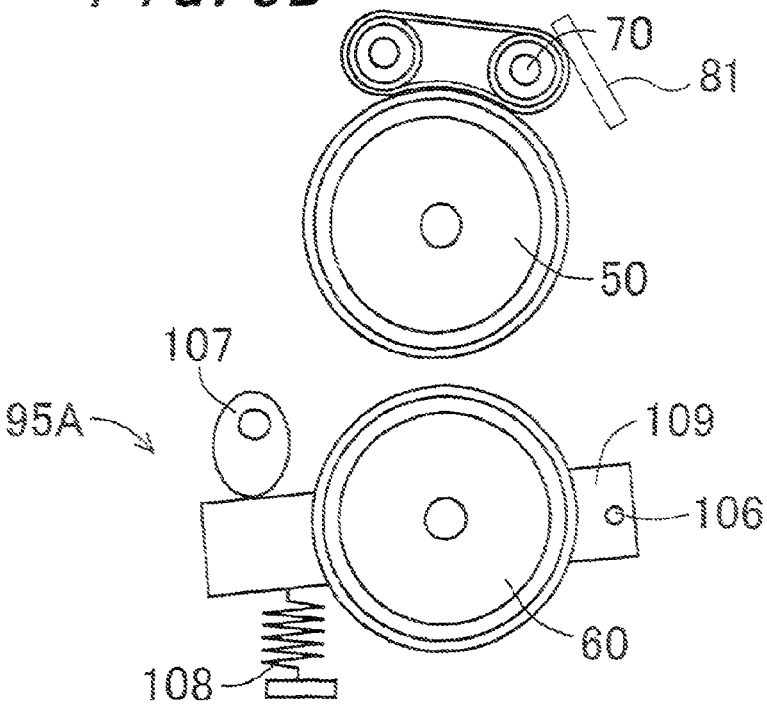

FIGS. 8A and 8B show a second contact/separation section 95A adapted to contact/separate the pressure roller 60 with respect to the fixing roller 50, where the cleaning section 80 is omitted. The second contact/separation section 95 is a member that contacts/separates the pressure roller 60 with respect to the fixing roller 50 to prevent plastic deformation of surfaces of the fixing roller and pressure roller, and serves as a vibration applying section adapted to peel the toner and the like by applying vibration to the scraper 81. The second contact/separation section 95A is including a sheet metal 109, a spindle 106, the eccentric cam 107 and a spring 108. FIG. 8A shows a state where the pressure roller 60 is brought into contact with the fixing roller 50, and FIG. 8B shows a state where the pressure roller 60 is separated from the fixing roller 50. Both ends of the pressure roller 60 are supported by a sheet metal 109 through bearings (not shown) and the like. Two sheet metals, which are not shown, are arranged so as to sandwich the pressure roller 60 therebetween. The sheet metal 109 is kept by a not-shown frame of the fixing device 6 and a spindle 106, to which a load is applied by a spring 108 in a direction to contact with the fixing roller 50 with the spindle 106 as a fulcrum. In this embodiment, an SUS is used as a material of the spring 108, and a spring constant thereof is 1.0 kgf/mm. Rotation of an eccentric cam 107 allows the sheet metal 109 to be angularly displaced with the spindle 106 as an axis and to move away from or contact with the fixing roller 50. In linkage with the movement of the sheet metal 109, the pressure roller 60 is capable of performing the contact/separation operation of contacting with or releasing pressure to the fixing roller 50. The rotation of the eccentric cam 107 is enabled by rotation from a motor (not shown). In this embodiment, the weight of the whole pressure roller 60 is about 260 g, and the rotation of the motor is controlled so that speed of the pressure roller 60 in contact is 150 mm/sec to apply sufficient vibration to the scraper 81.

Figure 9:
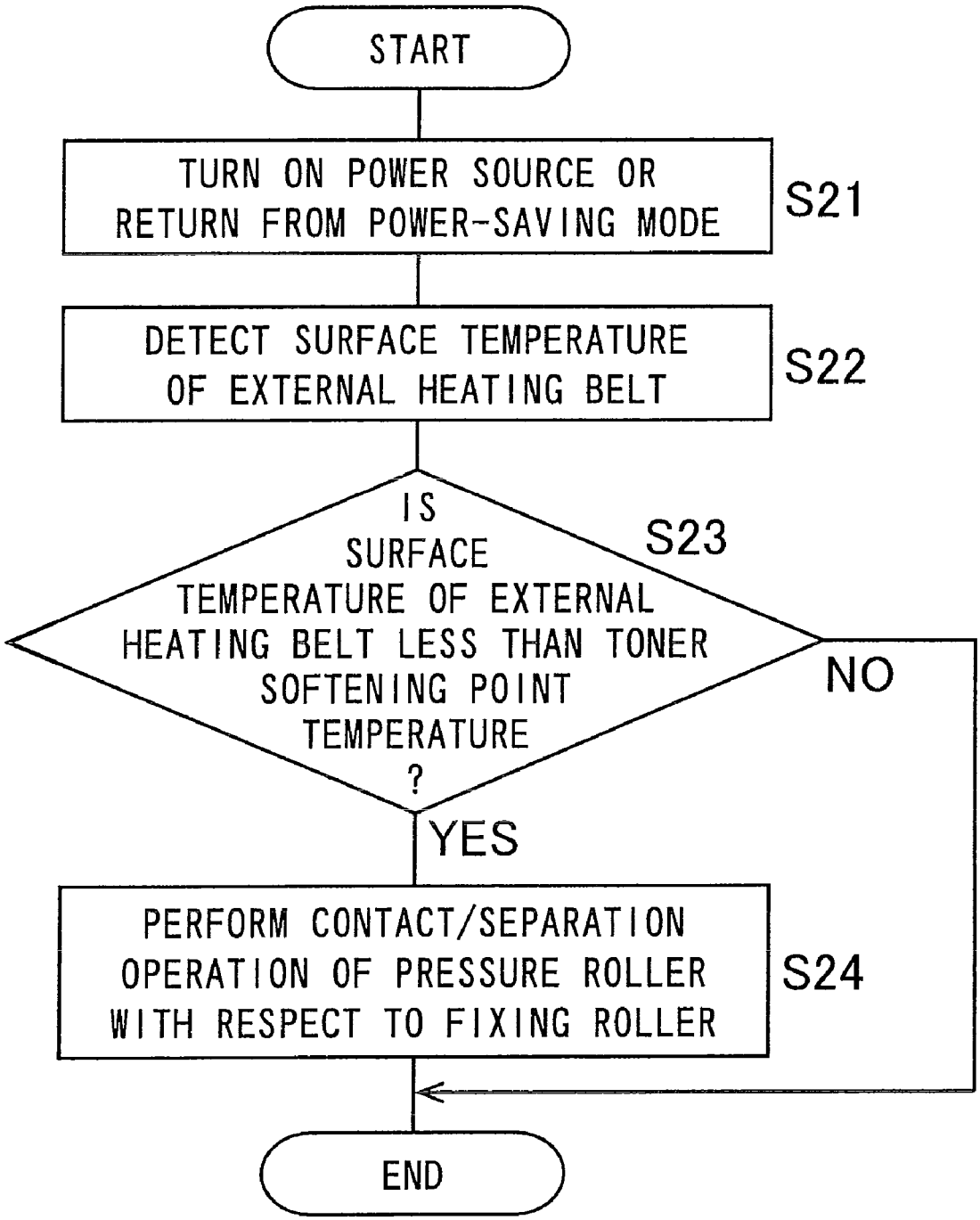
FIG. 9 is a flowchart showing an operation of the fixing device performed until a contact/separation operation of the pressure roller is finished after turning on a power source.

Next, description will be given for an operation of the fixing device 6 of the invention performed until a contact/separation operation of the pressure roller 60 is finished after turning on the power source, with reference to a flowchart of FIG. 9.

When the power source is turned on or restoring from a power-saving mode, the image forming apparatus 1 starts an operation (S21). The power-saving mode here shows a state where the CPU is energized but no electric power is supplied to all of the heating sections 54, 64, 74, and 75. The thermistor 76 detects the surface temperature of the external heating belt 71 of the external heating section 70 (S22). Whether the surface temperature is less than a softening temperature of toner or not less than the softening temperature of toner is determined by the CPU (S23). In this embodiment, the softening temperature of toner is about 120° C. When the surface temperature is less than the softening temperature of toner, the second contact/separation section 95A performs a contact/separation operation of the pressure roller 60 with respect to the fixing roller 50 (S24). The contact/separation operation may be performed only once or a plurality of times. With the contact/separation operation, vibration is applied to the scraper 81. Since the toner and the like scraped from the external heating belt 71 adhere to the scraper 81 due to rotation of the pressure-contact rollers 72 and 73, and the external heating belt 71 before the contact/separation operation is performed, the toner and the like are peeled off when the vibration is applied to the scraper 81, and then collected in the toner collecting box 82 arranged below the scraper 81. When the surface temperature of the external heating belt 71 is not less than the softening temperature of toner, the contact/separation operation is not performed. The reason for not performing the contact/separation operation is that, when the surface temperature is less than the softening temperature of toner, the viscosity of the adhering toner decreases and the toner and the like are easily peeled from the scraper 81 due to the vibration caused in the contact/separation operation, however, in the case of being not less than the softening temperature of toner, the viscosity of the adhering toner increases and is not completely peeled from the scraper 81 even when the vibration is applied.

The operation of heating the fixing roller 50 and the pressure roller 60 shown in FIG. 6 and the operation of contacting/separating the pressure roller 60 with/from the fixing roller 50 are independent and individual operations. That is, the operations may be performed simultaneously or one of the operations may be performed after the other operation is finished. After both the operations are finished, the recording material 8 is transported to the fixing device 6 to start the fixing processing. Moreover, as another embodiment of the invention, there may be provided the fixing device 6 with both the first contact/separation section 95 and the second contact/separation section 95A.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device, comprising:

a fixing section adapted to rotate around an axial line thereof, and heat toner in an unfixed toner image on a recording material to fuse the toner on the recording material;

a pressure section adapted to rotate and form a pressure-contact section between the pressure section and the fixing section by pressure-contact to the fixing section and apply pressure to the recording material bearing the unfixed toner image transported to the pressure-contact section to fix the toner on the recording material in cooperation with the fixing section; and an external heating section having a plurality of supporting rollers and a belt supported around the plurality of supporting rollers with tension so as to be rotatable, the belt being disposed so as to contact a circumferential surface of the fixing section from an outside to heat the circumferential surface; and a cleaning section adapted to contact the belt, and scrape contamination on a surface of the belt to thereby clean the surface; and a vibration applying section adapted to apply vibration to a scraper of the cleaning section by rotation of a cam.

2. The fixing device of claim 1, wherein the belt is made of a material having higher adherence to toner than on the circumferential surface of the fixing section.

3. The fixing device of claim 1, wherein the vibration applying section comprises a contact/separation section adapted to contact/separate the external heating section with/from the fixing section.

4. The fixing device of claim 1, wherein the vibration applying section comprises a contact/separation section adapted to contact/separate the pressure section with/from the fixing section.

5. The fixing device of claim 1, further comprising a detecting section adapted to detect temperature of the belt, wherein when the detected temperature is lower than a softening temperature of toner, the vibration applying section applies vibration to the cleaning section.

6. The fixing device of claim 1, wherein the cleaning section includes a toner collecting section adapted to collect the contamination scraped from the surface of the belt.

7. The fixing device of claim 6, wherein the toner collecting section has a bottom face inclined in a longitudinal direction of the fixing section.

8. An image forming apparatus provided with the fixing device of claim 1.

9. A fixing device, comprising:

a fixing section adapted to rotate around an axial line thereof, and heat a recording material bearing an unfixed toner image to fuse toner constituting the unfixed toner image on the recording material;

a pressure section adapted to rotate and form a pressure-contact section between the pressure section and the fixing section by pressure-contact to the fixing section and apply pressure to the recording material bearing the unfixed toner image transported to the pressure-contact section to fix the toner on the recording material in cooperation with the fixing section; and an external heating section having a plurality of supporting rollers and a belt supported around the plurality of supporting rollers with tension so as to be rotatable, the belt being disposed so as to contact a circumferential surface of the fixing section from an outside to heat the circumferential surface; and a cleaning section adapted to contact the belt, and scrape contamination on a surface of the belt to thereby clean the surface; and a vibration applying section adapted to apply vibration to the cleaning section, wherein the cleaning section includes a toner collecting section adapted to collect the contamination scraped from the surface of the belt, the toner collecting section having a bottom face inclined in a longitudinal direction of the fixing section.

10. The fixing device of claim 9, wherein the belt is made of a material having higher adherence to toner than on the circumferential surface of the fixing section.

11. The fixing device of claim 9, wherein the vibration applying section comprises a contact/separation section adapted to contact/separate the external heating section with/from the fixing section.

12. The fixing device of claim 9, wherein the vibration applying section comprises a contact/separation section adapted to contact/separate the pressure section with/from the fixing section.

13. The fixing device of claim 9, further comprising a detecting section adapted to detect temperature of the belt, wherein when the detected temperature is lower than a softening temperature of toner, the vibration applying section applies vibration to the cleaning section.

14. An image forming apparatus provided with the fixing device of claim 9.

* * * * *